US010750606B1

(12) United States Patent
Liu et al.

(10) Patent No.: US 10,750,606 B1
(45) Date of Patent: Aug. 18, 2020

(54) MICROWAVE PLASMA EQUIPMENT AND METHOD OF EXCITING PLASMA

(71) Applicant: INSTITUTE OF MICROELECTRONICS, CHINESE ACADEMY OF SCIENCES, Beijing (CN)

(72) Inventors: Xinyu Liu, Beijing (CN); Shengkai Wang, Beijing (CN); Yidan Tang, Beijing (CN); Yun Bai, Beijing (CN)

(73) Assignee: INSTITUTE OF MICROELECTRONICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 16/447,643

(22) Filed: Jun. 20, 2019

(30) Foreign Application Priority Data

Apr. 28, 2019 (CN) ..... 2019 1 0354079

(51) Int. Cl.
*H05H 1/46* (2006.01)

(52) U.S. Cl.
CPC ..... *H05H 1/46* (2013.01); *H05H 2001/4607* (2013.01)

(58) Field of Classification Search
None
See application file for complete search history.

(56) References Cited

U.S. PATENT DOCUMENTS 3,886,399 A * 5/1975 Symons ..... G21K 1/08 315/5
6,107,628 A * 8/2000 Smith ..... H01J 49/066 250/292
6,762,407 B2 * 7/2004 Kalinitchenko ..... H01J 49/061 250/294
7,579,589 B2 * 8/2009 Miller ..... G01N 27/624 250/281
7,608,818 B2 * 10/2009 Miller ..... G01N 27/624 250/281
9,006,972 B2 * 4/2015 Hopwood ..... C23C 16/24 315/111.01
9,247,629 B2 * 1/2016 Vahidpour ..... H05H 1/26
(Continued)

OTHER PUBLICATIONS

Liu et al., "High-mobility SiC MOSFET with low Dit using high pressure microwave plasma oxidation", Chin. Phys., vol. 29, No. 3, 2020, 7 pages.

(Continued)

*Primary Examiner* — Amy Cohen Johnson
*Assistant Examiner* — Srinivas Sathiraju
(74) *Attorney, Agent, or Firm* — Hamre, Schumann, Mueller & Larson, P.C.

(57) ABSTRACT

A microwave plasma equipment and a method of exciting plasma are disclosed. The microwave plasma equipment includes: a plasma reaction device having a cavity in which a base support and a plasma-forming area is provided; a conversion device having gradient electrodes, the gradient electrodes being disposed inside the cavity and configured to generate a gradient electric field in the plasma-forming area; a gas supply device configured to introduce gas into the cavity of the plasma reaction device; and a microwave generating device configured to generate and transmit microwave into the cavity of the plasma reaction device.

16 Claims, 6 Drawing Sheets

(56) References Cited

U.S. PATENT DOCUMENTS

| | | | | |
|---|---|---|---|---|
| 9,406,492 | B1 * | 8/2016 | Ramsey | H01J 49/165 |
| 9,491,841 | B2 * | 11/2016 | Jevtic | H01J 37/32467 |
| 9,635,750 | B2 * | 4/2017 | Cheung | H05H 1/30 |
| 9,706,635 | B2 * | 7/2017 | Jevtic | G01N 22/00 |
| 9,759,684 | B2 * | 9/2017 | Zimmermann | G01N 27/622 |
| 9,761,427 | B2 * | 9/2017 | Wouters | H01J 49/066 |
| 9,773,656 | B2 * | 9/2017 | Nishiguchi | H01J 49/22 |
| 9,875,884 | B2 * | 1/2018 | Lopez-Avila | H01J 49/049 |
| 10,204,774 | B2 * | 2/2019 | Benner | G01N 27/622 |
| 10,285,256 | B2 * | 5/2019 | Jevtic | G21B 1/057 |
| 10,407,770 | B2 * | 9/2019 | Inglis | C23C 16/01 |
| 2016/0254133 | A1 * | 9/2016 | Lopez-Avila | H01J 49/102 250/282 |
| 2016/0305909 | A1 * | 10/2016 | Zimmermann | G01N 27/622 |
| 2017/0098535 | A1 * | 4/2017 | Ramsey | H01J 49/165 |
| 2018/0005812 | A1 * | 1/2018 | Mavanur | H01J 49/005 |
| 2018/0012747 | A1 * | 1/2018 | Wouters | H01J 49/066 |
| 2018/0126381 | A1 * | 5/2018 | Huff | B01L 3/502761 |
| 2019/0198308 | A1 * | 6/2019 | Peterson | H01J 49/022 |
| 2019/0287781 | A1 * | 9/2019 | Ramsey | H01J 49/04 |

OTHER PUBLICATIONS

Liu et al., "High-pressure microwave plasma oxidation of 4H-SiC with low interface trap density", AIP Advances, vol. 9, Dec. 27, 2019, 6 pages.

* cited by examiner

MICROWAVE PLASMA EQUIPMENT AND METHOD OF EXCITING PLASMA

CROSS-REFERENCE TO RELATED APPLICATION

This application claims the benefit of Chinese Patent Application No. 201910354079.0 filed on Apr. 28, 2019 with the China National Intellectual Property Administration, the whole disclosure of which is incorporated herein by reference.

TECHNICAL FIELD

The present disclosure relates to the field of semiconductor technology and plasma physics, and in particular to a microwave plasma equipment and a method of exciting plasma by the microwave plasma equipment.

BACKGROUND

In the universe, plasma is the most important state of substance, which is also known as the fourth state of substance, i.e., the ionized "gas." It exhibits a highly excited and unstable state. The plasma includes ions (having charges of different polarity, i.e. positive or negative), electrons, atoms, and molecules. With the improvement of people's understanding of plasma, plasma technology has been developed rapidly. At present, plasma technology is widely used in the fields of physics, environment, semiconductor, etc., such as plasma smelting, plasma spraying, plasma welding, plasma etching, plasma oxidation, and the like.

The most common method for generating plasma is the gas discharge method. The main excitation methods include: DC discharge, AC discharge, RF discharge, laser excitation and microwave excitation. The microwave plasma is capable of converting microwave energy into internal energy of gas molecules, so that the gas is excited and ionized to form plasma. Compared with other plasmas formed by discharge, microwave plasma has many advantages including: (1) microwave plasma can avoid electrode contamination due to its high-frequency discharge without any electrode; (2) microwave plasma has higher electron temperature, higher electron density and wider emission spectrum; (3) the waveguide can be used to isolate the discharge region from the process region.

SUMMARY

The object of the present disclosure is to realize the generation and maintenance of atomic plasma by incorporating a conversion device into a microwave plasma equipment. The microwave plasma equipment can realize automatic adjustable excitation and particle selection between atomic plasma and molecular plasma.

The microwave plasma equipment provided by the embodiments of the present disclosure comprises:

a plasma reaction device having a cavity in which a base support and a plasma-forming area is provided;

a conversion device having gradient electrodes, the gradient electrodes being disposed inside the cavity and configured to generate a gradient electric field in the plasma-forming area;

a gas supply device configured to introduce gas into the cavity of the plasma reaction device; and a microwave generating device configured to generate and transmit microwave into the cavity of the plasma reaction device.

In some embodiments, the gradient electrodes comprise a plurality of electrode pairs, and each of the plurality of electrode pairs comprises a positive electrode and a negative electrode, wherein, each electrode in the plurality of electrode pairs has a strip-shaped structure and is shaped as a partial circle;

the positive electrode and the negative electrode included in each of the plurality of electrode pairs are arranged such that the positive electrode and the negative electrode form a circular profile.

In some embodiments, the strip-shaped structure corresponds to a central angle between 0 and 180 degrees.

In some embodiments, every two adjacent electrode pairs of the plurality of electrode pairs are located in two parallel planes respectively.

In some embodiments, the plurality of electrode pairs as a whole has a cylindrical profile.

In some embodiments, the plurality of electrode pairs as a whole has a conical profile.

In some embodiments, the plurality of electrode pairs are configured to be synchronously applied with different voltage values independently of each other, the different voltage values varying in a gradient.

In some embodiments, the gradient electrodes are configured to form a gradient electric field in which electric field intensity changes in gradient, and the base support and the gradient electrodes are configured such that a normal direction of the base support is the same as a direction in which the electric field intensity in the gradient electric field changes in gradient.

In some embodiments, the conversion device further comprises a spectrometer and a controller, wherein the spectrometer is configured to obtain an emission spectrum of plasma formed in the cavity, and the controller is configured to control the conversion device according to a type of the emission spectrum obtained by the spectrometer.

In some embodiments, when the type of the emission spectrum obtained by the spectrometer is molecular plasma, the controller controls the conversion device to generate the gradient electric field in the plasma-forming area.

In some embodiments, the controller is further configured to control the gas supply device to allow or forbid entry of gas into the cavity.

In some embodiments, the equipment further comprises:

a water cooling component disposed to surround the microwave generating device and the plasma reaction device.

The method of exciting plasma by the microwave plasma equipment according to the present disclosure comprises:

S1: generating plasma in the cavity of the plasma reaction device; and

S2: when the plasma generated in the cavity of the plasma reaction device is molecular plasma, generating the gradient electric field in the cavity by the gradient electrodes of the conversion device and converting the molecular plasma into atomic plasma by means of an electric field disturbance generated by the gradient electric field.

In some embodiments, the step S1 further comprises:

placing a substrate into the cavity of the plasma reaction device;

activating a vacuum pump to remove air in the cavity of the plasma reaction device and obtain a set vacuum degree, setting a condition as required for starting plasma, and waiting until the plasma is formed; and adjusting, after the plasma is formed, the microwave generating device and the gas supply device to achieve a predetermined power and pressure.

In some embodiments, the step S2 further comprises:

obtaining an emission spectrum of the plasma generated in the cavity of the plasma reaction device by a spectrometer;

when the emission spectrum obtained by the spectrometer is an emission spectrum of molecular plasma, generating the gradient electric field in the cavity by the gradient electrodes and forming atomic plasma by means of the electric field disturbance generated by the gradient electric field in the plasma-forming area within the cavity.

In some embodiments, the step of generating the gradient electric field in the cavity by the gradient electrodes of the conversion device comprises:

applying different voltage values synchronously to the gradient electrodes, wherein the different voltage values vary in a gradient, and in the gradient electric field formed by the gradient electrodes the electric field intensity varies in gradient in a direction perpendicular to the base support.

The advantages and technical effects of the present disclosure are as follows: when the substrate, e.g. silicon carbide, is treated by microwave plasma, the equipment according to the present disclosure for forming, selecting and maintaining the atomic plasma has the following advantages: 1) compared with the microwave plasma equipment in the prior art which is typically operated under low pressure, the microwave plasma equipment according to the present disclosure can also facilitate the generation of atomic plasma even under high pressure; (2) the microwave plasma equipment can realize the generation and maintenance of atomic plasma by means of a disturbance device; (3) in the case where the disturbance device is not started, the initial activated plasma, which is usually atomic plasma, will turn into molecular plasma after it lasts for about 2 minutes, and thus the molecular plasma will be maintained in the reaction cavity. Therefore, the microwave plasma equipment can realize the adjustable excitation between the molecular plasma and the atomic plasma, and has a very broad application prospect.

The invention performs study on microwave excited plasma from the perspective of a specific application of silicon carbide oxidation for example, and realizes the forming, maintenance and selecting of the atomic plasma excitation, and the adjustable excitation of the atomic plasma and the molecular plasma. Therefore, the microwave plasma equipment has great application perspective in performing processes such as plasma oxidation.

DETAILED DESCRIPTION OF EMBODIMENTS

Figure 1:
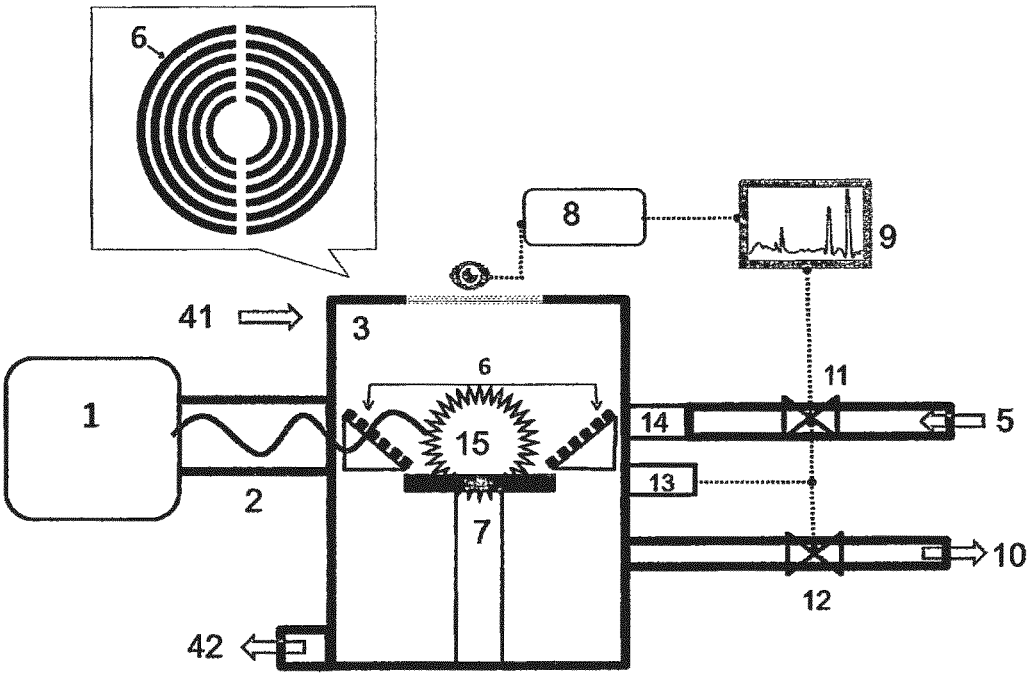
FIG. 1 shows a microwave plasma equipment according to an embodiment of the present disclosure.

The specific embodiments of the present disclosure are described in detail hereinafter. It should be noted that the embodiments described herein are merely described for the purpose of illustration and are not intended to limit the embodiments of the invention. In the following description, numerous specific details are set forth in order to provide a thorough understanding of the embodiments of the invention. It will be apparent, however, that one or more embodiments may be practiced without these specific details. In other instances, well-known structures and devices are schematically shown in order to avoid obscuring the embodiments of the invention.

In the entire specification, reference to "one embodiment", "an embodiment", "one example" or "an example" means that particular features, structures, or characteristics described in connection with the embodiment or the example are included in at least one embodiment of the invention. The phrase "in one embodiment", "in an embodiment", "in one example" or "in an example", which is mentioned at various positions throughout the specification, does not necessarily mean the same embodiment or example. Furthermore, the particular features, structures, or characteristics may be combined in one or more embodiments or examples in any suitable combination and/or sub-combination. Moreover, it will be understood by one of ordinary skill in the art that the term "and/or" as used herein includes any and all combinations of one or more associated listed items.

At present, there are relatively few studies on microwave plasma. The research on microwave plasma mostly focuses on the nature of microwave-excited plasma itself, and does not attempt to regulate and control the excitation type of the plasma.

In the initial period of plasma generation when plasma is generated by a microwave plasma equipment, the plasma is typically atomic plasma. However, as time passes by, atomic plasma typically tends to transform into molecular plasma which is more stable, especially under the condition of higher gas pressures. However, in some applications, such as an oxidation process or a nitridation process of a semiconductor substrate, more active atomic plasma is preferred.

According to the general concept of the present disclosure, there is provided a microwave plasma equipment comprising a plasma reaction device having a cavity, a conversion device, a gas supply device, and a microwave generating device. The conversion device comprises gradient electrodes for generating a gradient electric field in at least a portion (e.g., a plasma-forming area where the plasma is formed) of the cavity of the microwave plasma equipment.

Through the disturbance of the electric field, molecular plasma can be converted into atomic plasma. Further, since the electric field intensity in the gradient electric field is in a gradient distribution, the charged particle component in the atomic plasma can move in the gradient direction of the electric field intensity, thereby realizing the selecting of various particle components in the atomic plasma.

Here, as shown in FIG. 1, the core of a plasma reaction device is a cavity 3 in which a plasma reaction occurs. The cavity 3 includes a metal outer casing and a quartz tube placed therein.

In one embodiment, the plasma is generated by the following steps: supplying gas into the quartz tube; and after being reflected by the cavity, the microwave power is focused in a specific area within the quartz tube. The gas molecules absorb the microwave power in the specific area where the microwave power is focused and is ionized.

The plasma reaction device further comprises a base support 7 in its cavity 3 for supporting a substrate to be treated. The substrate may be smelted, sprayed, welded, etched, or oxidized by the plasma generated by the plasma reaction device. The base support can be raised up and lowered down. The base support 7 can be lowered to a bottom of the cavity 3 such that the substrate can be loaded onto the base support 7 through an opening at a bottom position. When the substrate is processed, the base support 7 can be raised up to a set position, which is generally the position to which the plasma ball 15 can affect. The position of the base support 7 after being raised can be located below the plasma-forming area as described above. In one embodiment, the base support 7 can also be rotated to evenly treat the surface of the substrate.

The conversion device is configured to apply electric field disturbance to the molecular plasma so as to form atomic plasma. The conversion device includes gradient electrodes 6. As shown in the insertion on the top left of FIG. 1, it schematically illustrates the top view of the gradient electrodes 6. The gradient electrodes 6 may include a plurality of electrode pairs, wherein each electrode pair including a positive electrode and a negative electrode. The positive and negative electrodes of each electrode pair are horizontally disposed opposite to each other above the base support 7 so as to form an electric field above the base support 7. The plurality of electrode pairs may be arranged vertically in the cavity 3 in a direction perpendicular to the base support 7. The electrode pairs are each independently controlled so as to be applied with different voltage (the voltage values applied to the plurality of electrode pairs varies in a gradient, i.e., increasing or decreasing sequentially), such that a gradient electric field is formed within the cavity. In the gradient electric field, the electric field intensity varies in a gradient, i.e. increasing or decreasing, in an up and down direction or in a vertical direction (i.e., in the direction perpendicular to the base support 7).

In a specific example, the plurality of electrode pairs are arranged in parallel. Each electrode of the plurality of electrode pairs has a strip-shaped structure and is shaped as a partial circle. A central angle, corresponding to the strip-shaped structure, is between 0 and 180 degrees. That's to say, each electrode is formed in a strip-shaped structure shorter than one half of a circle, as shown in the insertion on the top left of FIG. 1. The positive electrode and the negative electrode included in each electrode pair are arranged such that the positive electrode and the negative electrode can form a circular profile. Every two adjacent electrode pairs are arranged in parallel, that is, every two adjacent electrode pairs are located in two parallel planes respectively. The combination of the electrodes pairs may have a cylindrical profile. That's to say, the projections of the plurality of electrode pairs in the plane which is parallel to the planes where the electrodes pairs are located respectively coincide with each other. Alternatively, the combination of the plurality of electrode pairs may have a conical profile (as shown in FIG. 1), that is, the plurality of electrode pairs are not aligned in the vertical direction so that the projections of the plurality of electrode pairs in the plane which is parallel to the planes (e.g. a horizontal plane) where the electrodes pairs are located respectively don't overlap with each other. In an embodiment of the combination of electrode pairs having the conical profile as shown in FIG. 1, the distances between each electrode pair are different to each other.

In one embodiment, the conversion device further includes a fiber optic probe, an optical fiber, and a spectrometer 8 for collecting and detecting an emission spectrum of the plasma formed in the cavity. The optical fiber probe is disposed at an observation window on a side of the cavity and can be moved up and down, left and right so as to scan and observe the microwave power focusing area in the quartz tube and thus collect light generated by an excited gas in the plasma inside the plasma reaction device. The light is then transmitted to the spectrometer 8 through the optical fiber. The spectrometer 8 is configured to detect the light and then form the emission spectrum of the plasma.

In one embodiment, as shown in FIG. 1, the conversion device may further include a controller 9 coupled to the spectrometer 8 to receive from the spectrometer a signal indicating the type of emission spectrum of the plasma. When the signal received by the controller 9 indicates that the emission spectrum of the plasma is an emission spectrum of molecular plasma, the controller 9 controls the conversion device to convert the molecular plasma into atomic plasma. For example, the controller 9 may control the gas supply of the gas supply device, the voltage applied to each electrode pairs of the gradient electrodes 6, and the length of time for applying voltage. For example, under the control of the controller 9, a pulse voltage can be applied synchronously to the gradient electrodes 6. The controller 9 may control the pulse width, period, duration, voltage levels respectively applied to the plurality of electrode pairs, etc. of the pulse voltage.

The gas supply device is adapted to introduce gas into the cavity 3 of the plasma reaction device. The introduced gas is involved in the formation of plasma, and a gas discharge is generated by microwave excitation so as to form molecular plasma and/or atomic plasma. The gas supply device may include a gas cylinder 5 for storing the reaction gas, a vacuum pump 10 for removing the air from the plasma reaction device, a solenoid valve 11 and a flow meter 14 disposed in an intake line and adapted to control the supply of the reaction gas to the plasma reaction device; and a venting valve 12 disposed in an exhausting line and adapted to open or close the exhausting line. In one embodiment, the gas supply device further includes a pressure sensor 13 mounted on the plasma reaction device and adapted to measure the gas pressure within the cavity 3. The controller 9 described above may also be electrically coupled to the solenoid valve 11 and the venting valve 12 so as to open or close the solenoid valve 11 and the venting valve 12, facilitate the generation of the atomic plasma.

The microwave generating device comprises a microwave source 1 and a device (waveguide 2) for guiding the microwave into the cavity 3. The microwave source 1 may be various forms of microwave sources known in the prior art, as long as it can excite the gas so as to generate plasma. The waveguide 2 is disposed between the microwave source 1 and the plasma reaction device to guide microwaves generated by the microwave source into the cavity 3 of the plasma reaction device so as to excite the gas discharge and thus generate plasma. The microwave generating device may also include a control cabinet.

In an embodiment, the microwave plasma equipment may further comprise a water cooling component. A large amount of heat is generated during the generation of the plasma, and a corresponding cooling component is required to remove heat by means of heat exchange to ensure the normal operation of the entire microwave plasma equipment. In the embodiment of the present disclosure, the microwave generating device and the plasma reaction device are cooled by the water cooling component. One arrangement of the water cooling component is to provide it around the microwave generating device and the plasma reaction device. This arrangement can be achieved by providing a cooling conduit and introducing a circulating cooling medium (such as water) into the cooling conduit. In one embodiment, a cooling conduit having an inlet 41 and an outlet 42 is provided to surround the microwave generating device and the plasma reaction device. The cooling water is introduced into the cooling conduit through the inlet 41, passes by the microwave generating device and the plasma reaction device and then flows out through the outlet 42 at a lower portion of the cooling conduit. Through the circulation, the cooling medium inside the cooling conduit can take away the heat of the microwave generating device and the plasma reaction device.

According to still another aspect of the embodiments of the present disclosure, a method of exciting plasma is further provided, the method including:

S10: generating the plasma in the cavity of the plasma reaction device by the microwave generating device;

S20: when the plasma generated in the cavity is molecular plasma, generating a gradient electric field in the cavity by the gradient electrodes 6 of the conversion device and converting the molecular plasma into atomic plasma by means of an electric field disturbance generated by the gradient electric field.

Furthermore, under the action of the gradient electric field, the charged particle components in the atomic plasma may move downward toward the base support 7, so that more charged particles can be applied to a substrate on the base support 7.

In the above step S10, the plasma is generated by microwave excitation. Before the step S10, a plurality of preparation steps may be further included, including: confirming that a water cooling component and a gas supply device are in a normal working state; and checking whether water circulating and the gas supply device are normal. It may also include the step of placing a sample into a set position, which may include: lowering the base support 7 and placing the substrate thereon; and raising the base support 7 to the set position. It may further comprise the step of pre-adjusting a gas pressure in the cavity, and the step may include: activating a vacuum pump 10, and evacuating the plasma reaction device until a set vacuum (e.g., $1\times10^{-2}$ Pa) is reached.

In an embodiment, step S10 may include: energizing and starting the plasma reaction device and placing the substrate in the cavity 3; activating the vacuum pump 10 and evacuating the plasma reaction device to the set vacuum; setting a condition as required for starting plasma; waiting until the plasma is formed; and adjusting, after the plasma is formed, the microwave generating device and the gas supply device to achieve a predetermined power and pressure. The step of setting an ignition condition includes setting an input power of the microwave generating device in a microwave console and setting a gas pressure and a flow rate in a control device. In the step of setting an ignition condition, the microwave console and the control device are adjusted to achieve the power and pressure required for starting plasma. The required gas pressure may be in a range of 300 Pa-10 kPa, and the input power may be in a range of 300 W-3000 W. For example, an input power of 500 W, a gas pressure of 0.5 kPa, and a flow rate of 0.2 L/min may be used.

In step S20, the conversion device is configured to apply a gradient electric field disturbance to the molecular plasma so as to convert it into atomic plasma. Specifically, this step may include: obtaining an emission spectrum of the plasma (e.g., oxygen plasma) by the spectrometer 8; transmitting a signal indicating the type of the emission spectrum of the plasma to the controller 9; when the signal received by the controller 9 indicates that the emission spectrum is an emission spectrum of molecular plasma, controlling the conversion device by the controller 9 to convert the molecular plasma into atomic plasma. For example, under the control of the conversion device, voltages of 120V, 90V, 60V, 45V, 30V, and 15V are respectively applied to each electrode pair of the gradient electrodes (including 6 pairs of gradient electrodes in the embodiment shown in FIG. 1). The length of time for voltage application is, for example, 0.1 second. The gradient electric field is generated at the plasma "ball" 15 by the gradient electrode, thereby converting the molecular plasma to the atomic plasma. This cycle is continued until the emission spectrum received by the spectrometer is an emission spectrum of atomic plasma.

After the disturbance is generated by the gradient electrodes 6, the gas pressure in the cavity 3 of the plasma reaction device might deviate from the predetermined gas pressure. If the gas pressure in the cavity 3 of the plasma reaction device deviates from the predetermined gas pressure after the disturbance of the gradient electrodes 6, the pressure sensor 13 (coupled to the cavity 3 of the plasma reaction device) can detect the change of the gas pressure, generate an electrical signal and send it to the venting valve 12 at the vacuum pump 10 and the solenoid valve 11 at the gas cylinder 5 (for example, an oxygen cylinder), respectively, to open or close the two valves to adjust the gas pressure inside the cavity 3 of the plasma reaction device, such that the gas pressure inside the cavity 3 of the plasma reaction device may be stabilized at the predetermined gas pressure.

Optionally, the ratio of the excited atomic plasma and the excited molecular plasma can be adjusted by adjusting the length of time for which the voltage applied to each electrode pair of the gradient electrodes last.

The gas that may be used for the conversion device may include oxygen, nitrogen and/or a rare gas. Additionally, their isotopes can also produce the same effect. For example, by means of oxygen isotopes such as $^{16}O2$ and $^{18}O2$, the atomic oxygen plasma can also be excite and maintained.

In one embodiment, the plasma excitation method described above can be used for oxidation process, nitridation process, etc. of semiconductor materials, such as the oxidation to silicon, the oxidation to silicon carbide, or the nitridation to silicon carbide.

In order to make the above-described embodiments of the present disclosure more clarified, the following detailed description will be given by way of specific examples, but it should be understood that the following examples are only used to illustrate the invention, and the specific component arrangement and method steps are not be construed as a limitation to the microwave plasma equipment and the plasma excitation method of the present disclosure.

Example 1 specifically describes a microwave plasma equipment, and a plasma excitation method for realizing formation, selection, and maintenance of atomic oxygen plasma by means of the microwave plasma equipment.

The microwave plasma equipment provided by the present example, as shown in FIG. 1, comprises a microwave source 1, a microwave transmitting element 2, a plasma reaction device, a water cooling component 41 and 42, a gas supply device and a conversion device.

Figure 6:
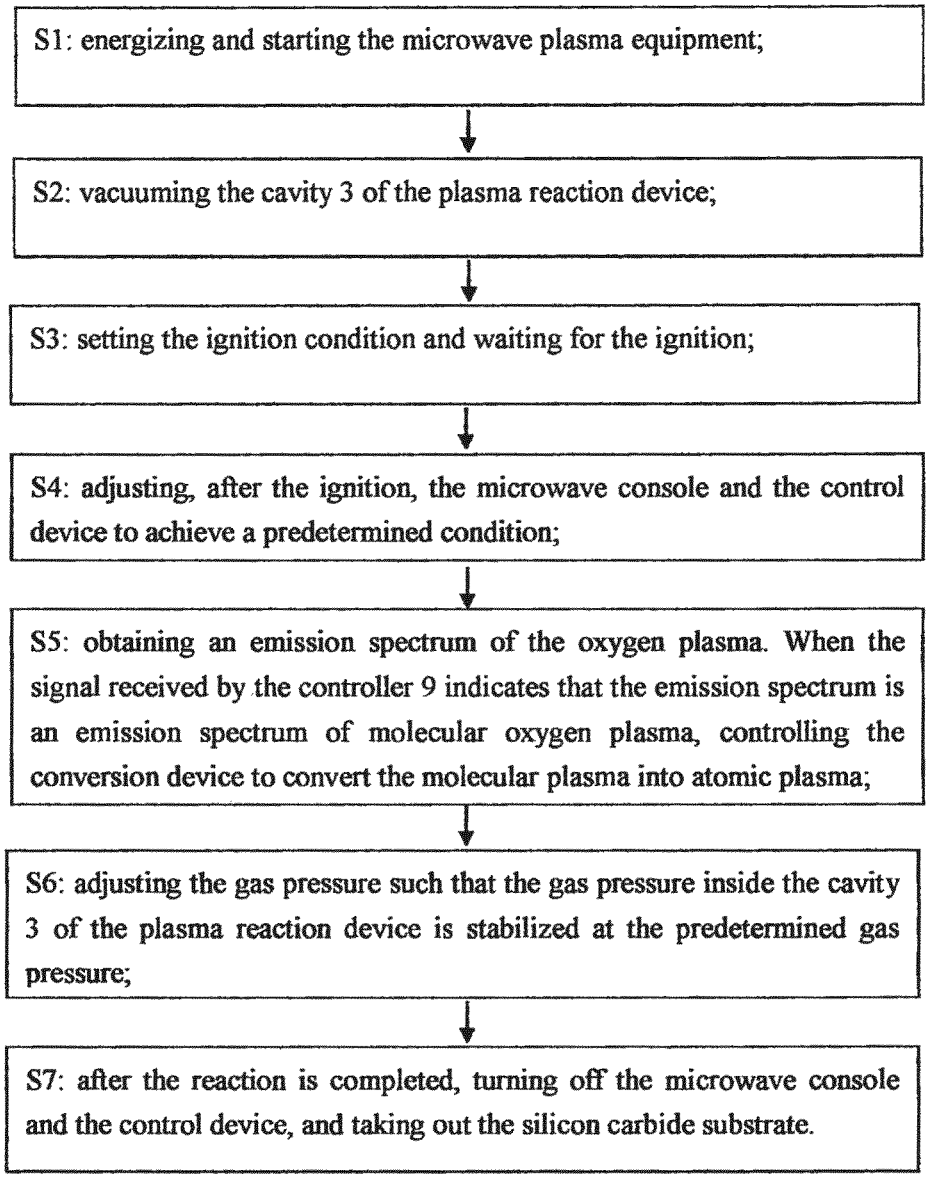
FIG. 6 is a flow chart of an excitation process of maintaining the atomic oxygen plasma by using the microwave plasma equipment according to the embodiment of the present disclosure, in a first example.

As shown in FIG. 6, the microwave plasma equipment can realize the excitation of the atomic oxygen plasma by the following steps:

Step 1 (S1): energizing and starting the microwave plasma equipment of the present disclosure to confirm that the circulating water, a cooling fan, and the gas cylinder are in a normal working state;

Step 2 (S2): lowering the base support 7, placing a silicon carbide substrate, and raising the base support 7; and activating the vacuum pump 10, vacuuming the cavity 3 of the plasma reaction device until the degree of vacuum reaches 6E-1;

Step 3 (S3): setting the ignition condition, and the gradient electrodes 6 are not in operation at this stage; specifically, setting the input power to be 400 W through the microwave console, setting the gas pressure to be 0.4 kPa, the flow rate to be 0.2 L/min through the control device, and waiting for the ignition;

Step 4 (S4): adjusting, after the ignition, the microwave console and the control device to achieve a predetermined condition. The predetermined condition used in this example include input power of 500 W, gas pressure of 0.5 kPa, and flow rate of 0.2 L/min;

Step 5 (S5): after ignition, obtaining an emission spectrum of the oxygen plasma by the spectrometer 8, and sending to the controller 9 a signal which indicates the type of the emission spectrum of the plasma. When the signal received by the controller 9 indicates that the emission spectrum is an emission spectrum of molecular oxygen plasma, controlling the conversion device by the controller 9 to convert the molecular plasma into atomic plasma. For example, under the control of the conversion device, voltages of 120V, 90V, 60V, 45V, 30V, and 15V are respectively applied to the 6 electrode pairs of the gradient electrodes. The length of time for voltage application is, for example, 0.1 second. The gradient electric field is generated at the plasma "ball" 15 by the gradient electrodes 6. This cycle is continued until the emission spectrum received by the spectrometer is an emission spectrum of atomic plasma;

Step 6 (S6): if the gas pressure in the cavity 3 of the plasma reaction device deviates from the predetermined gas pressure after the disturbance of the gradient electrodes 6, the pressure sensor 13 (coupled to the cavity 3 of the plasma reaction device) can detect the change of the gas pressure, generate an electrical signal and send it to the venting valve 12 at the vacuum pump 10 and the solenoid valve 11 at the oxygen cylinder 5, respectively, to open or close the two valves to adjust the gas pressure inside the cavity 3 of the plasma reaction device, such that the gas pressure inside the cavity 3 of the plasma reaction device is stabilized at the predetermined gas pressure; and Step 7 (S7): after the reaction is completed, turning off the microwave console and the control device, and taking out the silicon carbide substrate.

Figure 2:
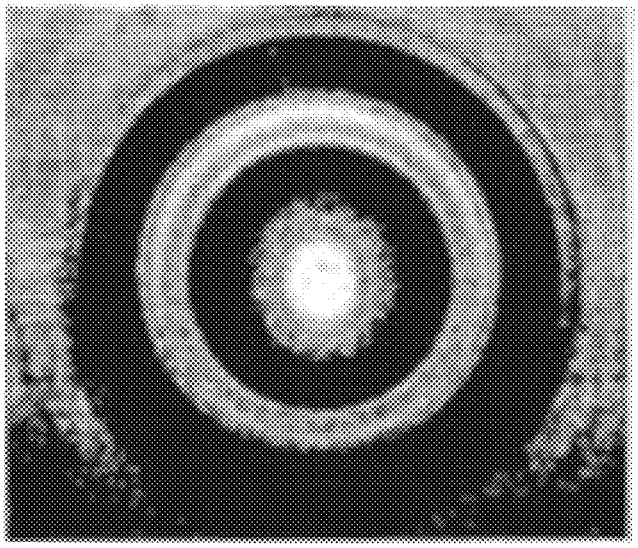
FIG. 2 shows a view of the molecular oxygen plasma "ball" generated in a first example.
Figure 3:
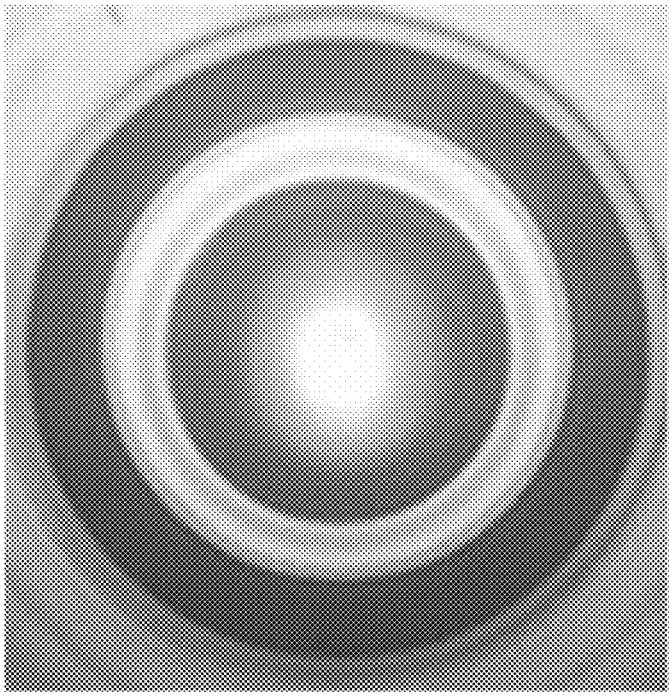
FIG. 3 shows a view of the atomic oxygen plasma "ball" generated in a first example.
Figure 4:
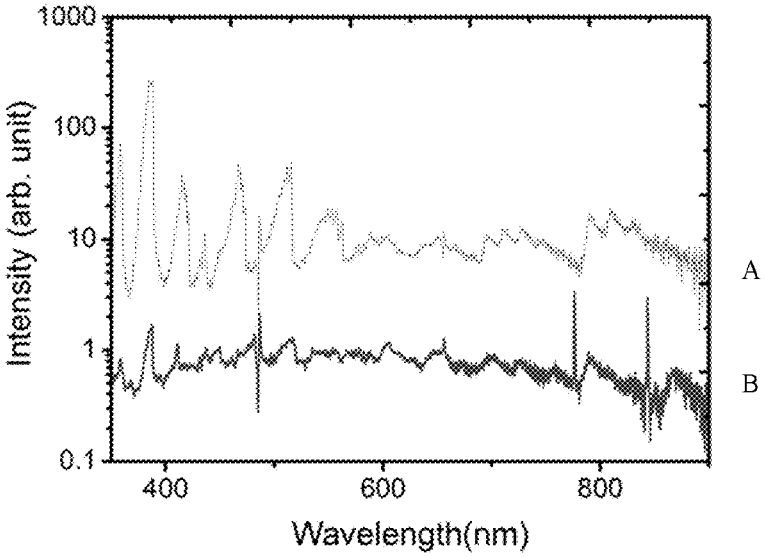
FIG. 4 shows the emission spectrum when the initially formed plasma has lasted for 2 minutes and the plasma emission spectrum acquired after performing the method according to the present disclosure for 15 minutes, in a same operation.

As can be seen from FIG. 4, in the same reaction, the equipment can stably maintain the excitation of the atomic oxygen plasma, which hardly changes with time. FIG. 4 includes emission spectrum A and B. The spectrum A is the emission spectrum when the initially formed plasma has lasted for 2 minutes, which shows that the plasma at this time is molecular oxygen plasma. At this time, the plasma shows blue color that the molecular oxygen plasma has, as shown in FIG. 2. Spectrum B is the plasma emission spectrum acquired after performing the method according to the present disclosure for 15 minutes. At 777 nm and 844 nm in this spectrum, there are characteristic peaks of atomic oxygen plasma. At this time, the plasma shows red color that the atomic oxygen plasma has, as shown in FIG. 3. It can be seen that the method provided by the above embodiment can realize the conversion from the molecular oxygen plasma to the atomic oxygen plasma, thereby stably maintaining the plasma as the atomic oxygen plasma.

Figure 5:
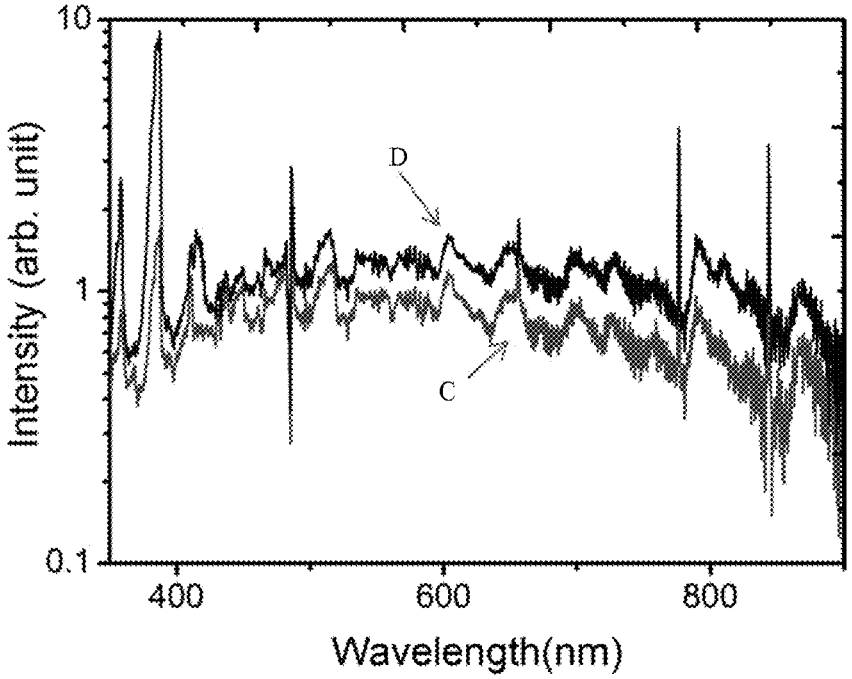
FIG. 5 shows the emission spectrum of the initially formed atomic oxygen plasma and a plasma emission spectrum acquired after performing the method according to the present disclosure for 15 minutes, in two operations at the same condition.

It can be seen from FIG. 5 that under the same reaction conditions, the equipment also has good stability at maintaining atomic oxygen plasma excitation. FIG. 5 includes emission spectrum C and D. The spectrum C is the emission spectrum of the initially formed atomic oxygen plasma, which has characteristic peaks of atomic oxygen plasma at 777 nm and 844 nm. Spectrum D is the plasma emission spectrum acquired after performing the method provided in the above examples for 15 minutes, which has characteristic peaks of atomic oxygen plasma at 777 nm and 844 nm, and it can be seen that the plasma can be stably maintained as the atomic oxygen plasma by the method provided in the above embodiment.

Figure 8:
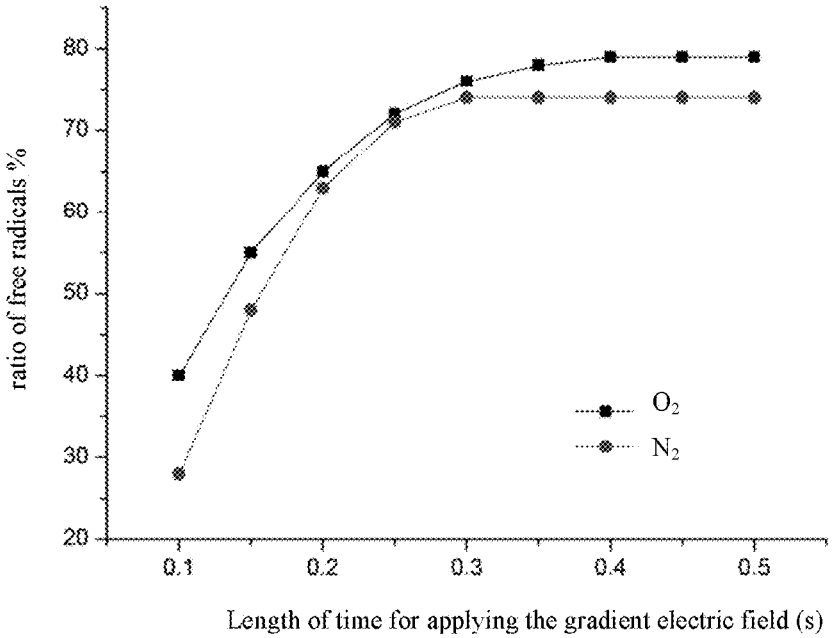
FIG. 8 shows a relationship between a ratio of free radicals in atomic oxygen plasma and atomic nitrogen plasma and the length of time for applying voltage to the gradient electrodes.

As can be seen from FIG. 8, for the atomic oxygen plasma, the ratio of free radicals of the oxygen atom to all atomic excited particles is 40%, when the application of the gradient electric field applied by the gradient electrodes last 0.1s each time. As the length of time for applying the gradient electric field increases, for example, increasing from 0.1 s to 0.5s as shown in FIG. 8, the ratio of free radicals of oxygen atom to all atomic excited particles increases from 40% to about 80%. As shown in FIG. 8, this trend is also applicable to nitrogen atoms. Therefore, by adjusting the length of time for applying the gradient electric field each time, the ratio of free radicals to all atomic excited particles can be adjusted.

Example 2 specifically describes a plasma excitation method for realizing formation, selection, and maintenance of atomic nitrogen plasma by means of the microwave plasma equipment according to an embodiment of the present disclosure.

The microwave plasma equipment provided in the second example, as shown in FIG. 1, includes a microwave source, a microwave transmitting element 2, a plasma reaction device 3, and a water cooling component 41 and 42, a gas supply device and a conversion device.

Figure 7:
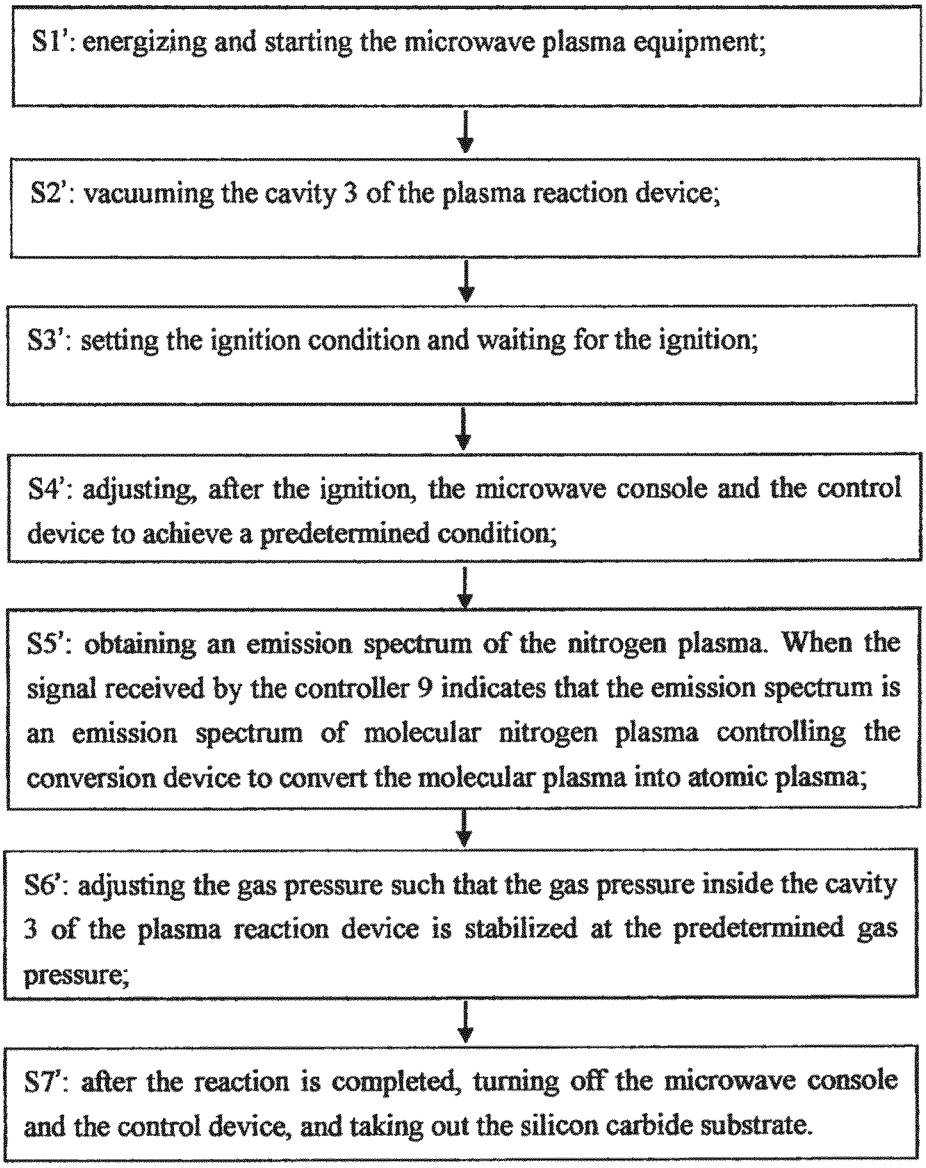
FIG. 7 is a flow chart of an excitation process of maintaining the atomic nitrogen plasma by using the microwave plasma equipment according to the embodiment of the present disclosure, in a second example.

As shown in FIG. 7, the microwave plasma equipment can realize the excitation of the atomic nitrogen plasma by the following steps:

Step 1 (S1'): energizing and starting the microwave plasma equipment of the present disclosure to confirm that the circulating water, a cooling fan, and the gas cylinder are in a normal working state;

Step 2 (S2'): lowering the base support 7, placing a silicon carbide substrate, and raising the base support 7; and activating the vacuum pump 10, vacuuming the cavity 3 of the plasma reaction device until the degree of vacuum reaches 5E-1;

Step 3 (S3'): setting the ignition condition; specifically, setting the input power to be 300 W through the microwave console, setting the gas pressure to be 0.3 kPa, the flow rate to be 0.4 L/min through the control device, and waiting for the ignition;

Step 4 (S4'): adjusting, after the ignition, the microwave console and the control device to achieve the predetermined condition. The predetermined condition used in this example includes input power of 700 W, gas pressure of 6 kPa, flow rate of 0.4 L/min;

Step 5 (S5'): after ignition, obtaining an emission spectrum of the nitrogen plasma by the spectrometer 8, and sending to the controller 9 a signal which indicates the type of the emission spectrum of the plasma. When the signal received by the controller 9 indicates that the emission spectrum is an emission spectrum of molecular nitrogen plasma, controlling the conversion device by the controller 9 to convert the molecular plasma into atomic plasma. For example, under the control of the conversion device, voltages of 120V, 90V, 60V, 45V, 30V, and 15V are respectively applied to the 6 electrode pairs of the gradient electrodes. The voltage application lasts for 0.15 second. The gradient electric field is generated at the plasma "ball" 15 by the gradient electrodes 6. This cycle is continued until the emission spectrum received by the spectrometer is an emission spectrum of the atomic plasma. In this example, for the atomic nitrogen plasma, the ratio of free radicals to all atomic excited particles is 48%;

Step 6 (S6'): if the gas pressure in the cavity 3 of the plasma reaction device deviates from the predetermined gas pressure after the disturbance of the gradient electrodes 6, the pressure sensor 13 (coupled to the cavity 3 of the plasma reaction device) can detect the change of the gas pressure, generate an electrical signal and send it to the venting valve 12 at the vacuum pump 10 and the solenoid valve 11 at the nitrogen cylinder 5, respectively, to open or close the two valves to adjust the gas pressure inside the cavity 3 of the plasma reaction device, such that the gas pressure inside the cavity 3 of the plasma reaction device is stabilized at the predetermined gas pressure; and Step 7 (S7'): after the reaction is completed, turning off the microwave console and the control device, and taking out the silicon carbide substrate.

In the above, the microwave plasma equipment and the plasma excitation method of the embodiment of the present disclosure are introduced, which can realize the generation and maintenance of atomic plasma by means of gradient electric field disturbance. Additionally, the ratio of the excited molecular plasma to the excited atomic plasma can be adjusted as needed.

The specific embodiments described above further explain the objects, technical solutions and beneficial effects of the present disclosure. It should be understood that the foregoing description are merely the specific embodiments of the present disclosure and should not be construed as limitation to the present disclosure, all modifications, equivalents, improvements, etc., made within the spirit and scope of the invention are intended to be included within the scope of the invention.

What is claimed is:

1. A microwave plasma equipment, comprising:

a plasma reaction device having a cavity in which a base support and a plasma-forming area is provided;

a conversion device having gradient electrodes, the gradient electrodes being disposed inside the cavity and configured to generate a gradient electric field in the plasma-forming area;

a gas supply device configured to introduce gas into the cavity of the plasma reaction device; and a microwave generating device configured to generate and transmit microwave into the cavity of the plasma reaction device.

2. The microwave plasma equipment according to claim 1, wherein the gradient electrodes comprise a plurality of electrode pairs, and each of the plurality of electrode pairs comprises a positive electrode and a negative electrode, wherein, each electrode in the plurality of electrode pairs has a strip-shaped structure and is shaped as a partial circle;

the positive electrode and the negative electrode included in each of the plurality of electrode pairs are arranged such that the positive electrode and the negative electrode form a circular profile.

3. The microwave plasma equipment according to claim 2, wherein the strip-shaped structure corresponds to a central angle between 0 and 180 degrees.

4. The microwave plasma equipment according to claim 2, wherein every two adjacent electrode pairs of the plurality of electrode pairs are located in two parallel planes respectively.

5. The microwave plasma equipment according to claim 2, wherein the plurality of electrode pairs as a whole has a cylindrical profile.

6. The microwave plasma equipment according to claim 2, wherein the plurality of electrode pairs as a whole has a conical profile.

7. The microwave plasma equipment according to claim 2, wherein the plurality of electrode pairs are configured to be synchronously applied with different voltage values independently of each other, the different voltage values varying in a gradient.

8. The microwave plasma equipment according to claim 2, wherein the gradient electrodes are configured to form a gradient electric field in which electric field intensity changes in gradient, and the base support and the gradient electrodes are configured such that a normal direction of the base support is the same as a direction in which the electric field intensity in the gradient electric field changes in gradient.

9. The microwave plasma equipment according to claim 1, wherein the conversion device further comprises a spectrometer and a controller, wherein the spectrometer is configured to obtain an emission spectrum of plasma formed in the cavity, and the controller is configured to control the conversion device according to a type of the emission spectrum obtained by the spectrometer.

10. The microwave plasma equipment according to claim 9, wherein when the type of the emission spectrum obtained by the spectrometer is molecular plasma, the controller controls the conversion device to generate the gradient electric field in the plasma-forming area.

11. The microwave plasma equipment according to claim 9, wherein the controller is further configured to control the gas supply device to allow or forbid entry of gas into the cavity.

12. The microwave plasma equipment according to claim 1, further comprising:

a water cooling component disposed to surround the microwave generating device and the plasma reaction device.

13. A method of exciting plasma by the microwave plasma equipment according to claim 1, the method comprising:

S1: generating plasma in the cavity of the plasma reaction device; and

S2: when the plasma generated in the cavity of the plasma reaction device is molecular plasma, generating the gradient electric field in the cavity by the gradient electrodes of the conversion device and converting the molecular plasma into atomic plasma by means of an electric field disturbance generated by the gradient electric field.

14. The method according to claim 13, wherein the step S1 further comprises:

placing a substrate into the cavity of the plasma reaction device;

activating a vacuum pump to remove air in the cavity of the plasma reaction device and obtain a set vacuum degree, setting a condition as required for starting plasma, and waiting until the plasma is formed; and adjusting, after the plasma is formed, the microwave generating device and the gas supply device to achieve a predetermined power and pressure.

15. The method according to claim 13, the step S2 further comprises:

obtaining an emission spectrum of the plasma generated in the cavity of the plasma reaction device by a spectrometer;

when the emission spectrum obtained by the spectrometer is an emission spectrum of molecular plasma, generating the gradient electric field in the cavity by the gradient electrodes and forming atomic plasma by means of the electric field disturbance generated by the gradient electric field in the plasma-forming area within the cavity.

16. The method according to claim 13, wherein the step of generating the gradient electric field in the cavity by the gradient electrodes of the conversion device comprises:

applying different voltage values synchronously to the gradient electrodes, wherein the different voltage values vary in a gradient, and in the gradient electric field formed by the gradient electrodes the electric field intensity varies in gradient in a direction perpendicular to the base support.

* * * * *